US006652288B2

(12) United States Patent
Laukhuf et al.

(10) Patent No.: US 6,652,288 B2
(45) Date of Patent: Nov. 25, 2003

(54) ELECTRICAL DISTRIBUTION BLOCK

(75) Inventors: Gregg E. Laukhuf, Bryan, OH (US); Raymond H. Riner, Hicksville, OH (US)

(73) Assignee: Dekko Engineering, Inc., Butler, IN (US)

( * ) Notice: Subject to any disclaimer, the term of this patent is extended or adjusted under 35 U.S.C. 154(b) by 0 days.

(21) Appl. No.: 10/120,749

(22) Filed: Apr. 11, 2002

(65) Prior Publication Data

US 2003/0194884 A1 Oct. 16, 2003

(51) Int. Cl.[7] ..... H01R 41/00
(52) U.S. Cl. ..... 439/32; 439/215
(58) Field of Search ..... 439/32, 215, 211, 439/454; 174/48, 49

(56) References Cited

U.S. PATENT DOCUMENTS

| | | | | |
|---|---|---|---|---|
| 1,865,600 A | | 7/1932 | Welch | |
| 1,917,009 A | | 7/1933 | Betts et al. | |
| 2,945,201 A | | 7/1960 | Waninger | 339/49 |
| 3,016,509 A | | 1/1962 | Waninger | 339/49 |
| 3,065,446 A | | 11/1962 | Robb et al. | 339/184 |
| 3,601,759 A | | 8/1971 | Barker | 339/59 |
| 3,670,291 A | | 6/1972 | Garcia | 339/92 |
| 4,553,798 A | * | 11/1985 | Murphy | 339/9 |
| 5,041,002 A | | 8/1991 | Byrne | 439/215 |
| 5,941,720 A | * | 8/1999 | Byrne | 439/215 |
| 6,036,516 A | * | 3/2000 | Byrne | 439/215 |

* cited by examiner

*Primary Examiner*—Alexander Gilman
(74) *Attorney, Agent, or Firm*—Taylor & Aust, P.C.

(57) ABSTRACT

An electrical distribution block suitable for use in modular wall systems of various thicknesses. The electrical distribution block includes branch connectors spaced from each other by an electrically conductive bridge having a telescopic engagement such that a spacing between the branch connectors can be selectively controlled for use in modular walls of different thickness.

21 Claims, 2 Drawing Sheets

ELECTRICAL DISTRIBUTION BLOCK

BACKGROUND OF THE INVENTION

1. Field of the Invention

The present invention pertains generally to modular electrical systems used in modular wall systems, and, more particularly, relates to a distribution block for distributing electrical current to a plurality of components attached to the distribution block.

2. Description of the Related Art

Modular wall systems are used in many situations to construct temporary, or at least rearrangeable office configurations. With the proliferation of computer work stations, and the decreasing costs for obtaining and operating various office equipment including printers, scanners, fax machines and the like, the installations of such equipment have increased, and there is an ever increasing need for electrical, communication and data transmission circuits in each defined work space. Rearrangement of the work space defined by the panels, and/or rearrangement of the equipment within the work space can result in the need to relocate the various receptacles to avoid unsightly and unsafe dependence on extension cords.

To meet the need for relocatable and expandable electrical, data and communication circuitry in modular wall systems, it is known to provide a wire race in the modular wall, commonly near the bottom thereof. Plugable circuit components may include distribution, jumper and receptacle elements that can be combined and configured to achieve the desired outlet locations.

As needs have increased, it has become more common to require receptacles on both sides of the modular wall. Separate distribution components can be used, but this requires a relatively large wire race, and can result in an undesirable amount of wires or cables in the wire race. Alternatively, components can be used to service both sides of a wall panel. Unfortunately, wall panels are provided in a variety of different thicknesses, and it has been necessary to stock specialized components for each wall width if single components are to be used to service both sides of the wall. Supply costs and storage space are increased by each different wall thickness being used.

What is needed in the art is a distribution terminal block that can accommodate both sides of a modular wall, and is adjustable for walls of different thicknesses.

SUMMARY OF THE INVENTION

The present invention provides an electrical distribution block that is adjustable in width, to accommodate walls of different thickness.

The invention comprises, in one form thereof, an electrical distribution block with a first connector assembly having a first plurality of electrical branch connectors and a first bridge portion including first bridge connectors electrically connected to the first plurality of electrical branch connectors. A second connector assembly has a second plurality of branch connectors and a second bridge portion including second bridge connectors electrically connected to the second plurality of electrical branch connectors. The bridge connectors of the first bridge portion and the bridge connectors of the second bridge portion are adapted for direct electrical connection to each other along a variable length establishing a variable spacing between the first connector assembly branch connectors and the second connector assembly branch connectors.

In another form thereof, the invention provides an electrical distribution block with a first T-shaped connector assembly having first and second branch connectors extending in opposite directions relative to each other, and first bridge connectors extending perpendicular thereto. A second T-shaped connector assembly has third and fourth branch connectors extending in opposite directions relative to each other, and second bridge connectors extending perpendicular thereto. The first and second bridge connectors are adapted for telescopic engagement with each other.

In a further form thereof, the invention provides an electrical distribution block with first and second oppositely directed branch connectors; third and fourth oppositely directed branch connectors disposed in parallel, spaced relation to the first and second branch connectors; and an electrical bridge disposed between and electrically connecting the first and second branch connectors with the third and fourth branch connectors.

An advantage of the present invention is providing a distribution block that can be connected in a distribution line to accommodate several receptacles, and can be coupled with a variety of modular components.

Another advantage of the invention is providing a distribution block which is adjustable to fit in modular walls of different thickness, to provide receptacle sites along opposite wall surfaces of a modular wall panel.

A further advantage of the invention is providing a distribution block having a variety of applications, thereby reducing the number of parts required in modular electrical power distribution systems.

BRIEF DESCRIPTION OF THE DRAWINGS

The above-mentioned and other features and advantages of this invention, and the manner of attaining them, will become more apparent, and the invention will be better understood by reference to the following description of an embodiment of the invention, taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
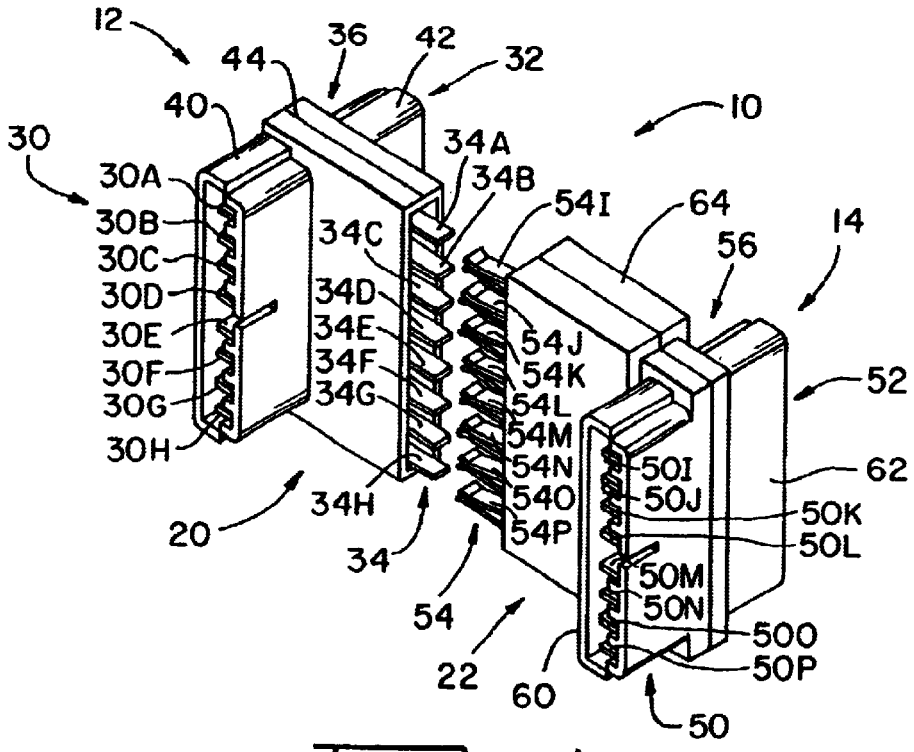
FIG. 1 is an exploded perspective view of an electrical distribution block according to the present invention.
Figure 2:
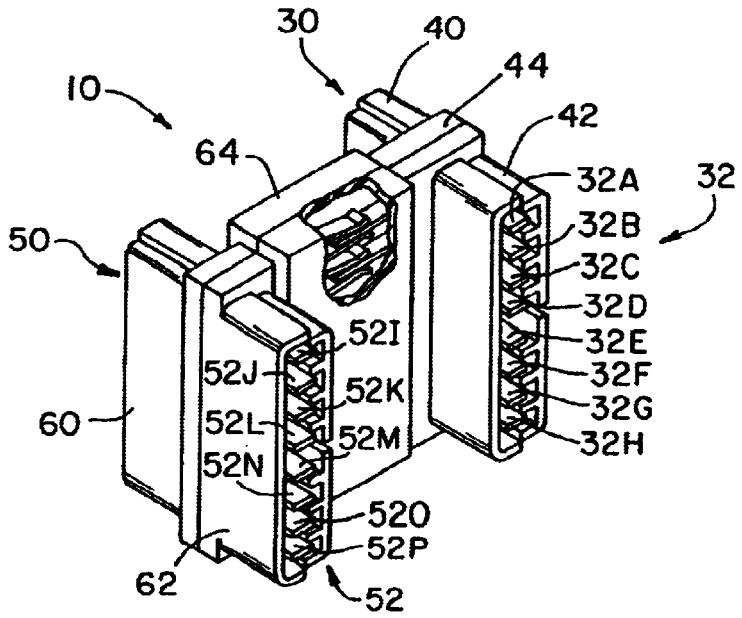
FIG. 2 is a perspective view, partially broken away, of the distribution block of FIG. 1, shown in an assembled condition from the side opposite the side shown in FIG. 1.

Referring now more specifically to the drawings, and to FIG. 1 in particular, an electrical distribution block 10 of the present invention is shown. Distribution block 10 includes a first connector assembly 12 and a second connector assembly 14, each adapted for connection to each other to form an electrically coupled structure having four sites for connecting to other components of a modular electrical distribution system 16, described in greater detail hereinafter, illustrated in a modular wall panel 18 shown in phantom lines in FIG. 3. First connector assembly 12 and second connector assembly 14 are joined to each other through first and second bridge portions 20 and 22.

First connector assembly 12 is a substantially T-shaped structure, and includes a group of first branch connectors 30 and a group of second branch connectors 32 disposed and arranged in substantially opposite direction. First and second branch connectors 30 and 32 are configured for connection to and with other components of electrical distribution system 16 to be described hereinafter.

First connector assembly 12, and specifically first bridge portion 20 thereof, includes first bridge connectors 34 electrically coupled to first and second branch connectors 30 and 32. Bridge connectors 34 are disposed perpendicular to first and second branch connectors 30 and 32. As those skilled in the art will readily understand, first and second branch connectors 30 and 32 and bridge connectors 34 may be formed as a series of stacked, individual terminals A, B, C, D, E, F, G and H, each such terminal being essentially T-shaped and having ends each corresponding to one of the branch connectors 30 and 32 and bridge connector 34. Thus, terminal A has first branch connector terminal end 30A, second branch connector terminal end 32A and bridge connector terminal end 34A. The respective first and second branch connector ends 30B–30H and 32B–32H and bridge connectors 34B–H are also shown. In various applications of the present invention, a distribution block 10 may include more or fewer first branch connectors 30, second branch connectors 32 and bridge connectors 34 than as shown.

A generally T-shaped housing 36 is provided and includes first and second branch connector housings 40 and 42 surrounding first and second branch connectors 30 and 32, respectively, and a bridge connector housing 44 surrounding bridge connectors 34.

Second connector assembly 14 is also a substantially T-shaped structure, and includes a group of third branch connectors 50 and a group of fourth branch connectors 52 disposed and arranged in substantially opposite directions. Third and fourth branch connectors 50 and 52 also are configured for connection to and with other components of electrical system 16 to be described hereinafter.

Second connector assembly 14, and more specifically second bridge portion 22 thereof, further includes second bridge connectors 54 electrically coupled to third and fourth branch connectors 50 and 52. Bridge connectors 54 are disposed substantially perpendicular to third and fourth branch connectors 50 and 52. Third and fourth branch connectors 50 and 52 and second bridge connectors 54 likewise may be formed as a series of stacked individual terminals I, J, K, L, M, N, 0 and P. Each terminal is essentially T-shaped and includes third and fourth branch connector ends 50I–P and 52I–P, respectively, and bridge connector ends 54I–P. In various applications of the present invention, a distribution block 10 may include more or fewer third branch connectors 50, fourth branch connectors 52 and second bridge connectors 54 than as shown.

A generally T-shaped housing 56 is provided for second connector assembly 14 and includes third and fourth branch connector housings 60 and 62 surrounding third and fourth branch connectors 50 and 52, respectively, and a second bridge connector housing 64 surrounding bridge connectors 54.

First connector assembly 12 and second connector assembly 14 are complementary halves forming distribution block 10. First connector assembly 12 and second connector assembly 14 join to each other through first and second bridge connectors 34 and 54 and first and second bridge connector housings 44 and 64 of first and second bridge portions 20 and 22. First bridge connectors 34 are formed as male terminals, comprising an elongated flat blade. Second bridge connectors 54 are formed as female terminals having upper and lower elements biased toward each other at the outer ends thereof. First bridge connectors 34 are received in second bridge connectors 54 and provide electrical conductivity therethrough. Electrical contact can be made anywhere along the lengths of first bridge connectors 34. It should be understood that first and second bridge connectors 34 and 54 can be of other shapes and forms, and each may include a combination of male and female terminals.

First bridge connector housing 44 is provided sufficiently smaller in cross-section to be received in second bridge connector housing 64. As thus configured, first and second bridge connectors 34 and 54 and first and second bridge connector housings 44 and 64 are telescopically engaged one with the other such that they can be overlappingly engaged to a greater or lesser length as desired. In doing so, first and second branch connectors 30 and 32, which are oppositely directed relative to each other and substantially parallel to the similarly oppositely directed third and fourth branch connectors 50 and 52, can be selectively arranged spaced a selectively greater or lesser distance from third and fourth branch connectors 50 and 52. In this manner, connector block 10 can be adjusted to fit in modular wall panels 18 of different thickness, and can function to provide electrical service to both sides of modular wall panel 18.

First, second, third and fourth branch connectors 30, 32, 50 and 52, respectively, are each similarly configured to be electrically connected to other components of modular electrical distribution system 16, and a plurality of distribution blocks 10 can be used in configuring electrical distribution system 16 as desired.

Figure 3:
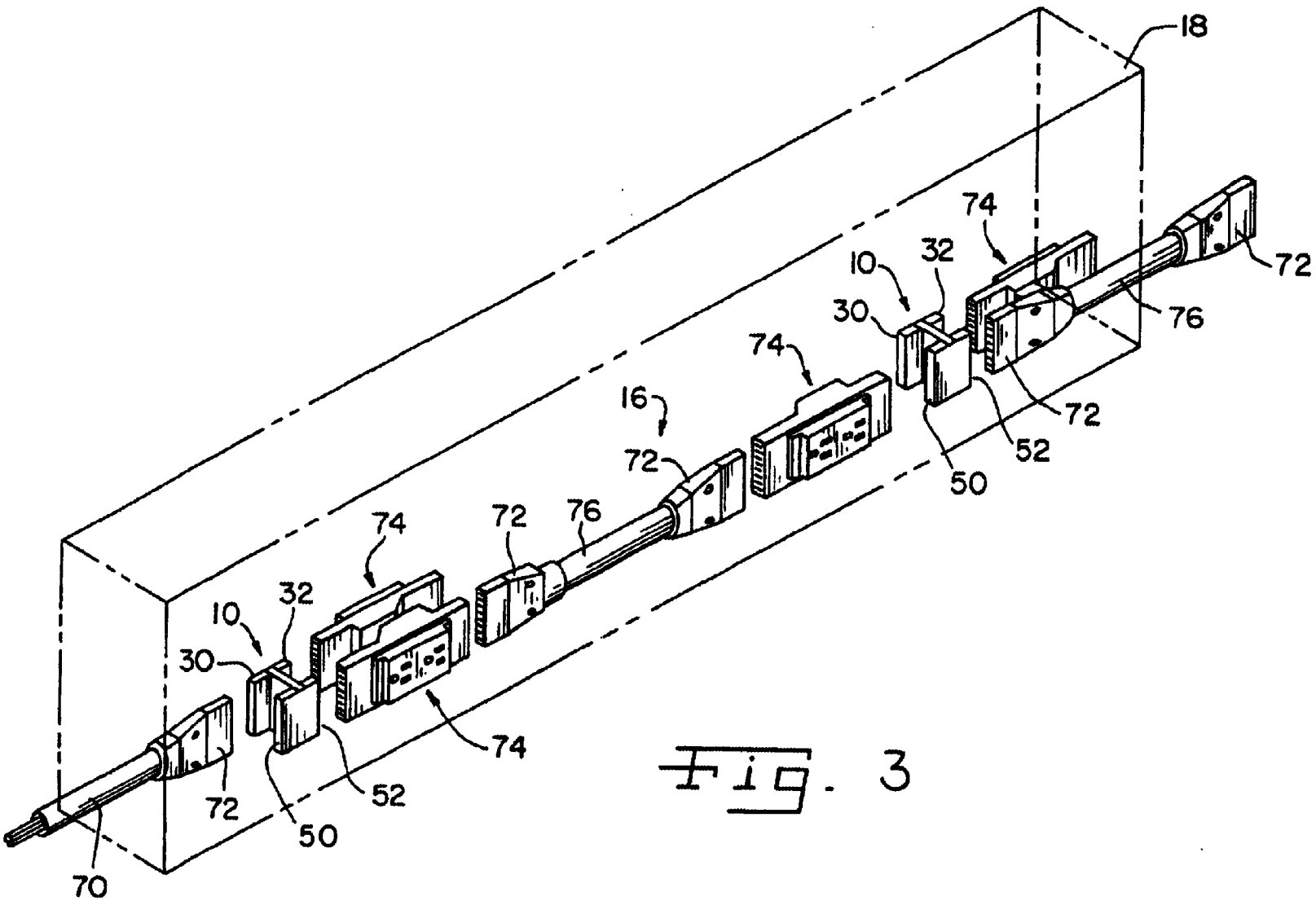
FIG. 3 is a perspective view of a modular electrical distribution system in which distribution blocks of the present invention are used.

An example of the manner in which several distribution blocks 10 can be used is illustrated in FIG. 3. Assuming modular wall panel 18 is a first section of a wall system, a power entry cable 70 is provided from an electrical power source (not shown) that may be an electrical breaker box or the like. With a first distribution block 10 oriented to have first and third branch connectors 30 and 50 facing toward power entry cable 70, an end connector 72 on cable 70 can be connected to either first branch connectors 30 or third branch connectors 50. Electrical current is thus available at second and fourth branch connectors 32 and 52 and the other of first and third branch connectors 30 or 50 that is not connected to connector 72 of cable 70. Various combinations of receptacles 74 and jumper cables 76 having similar end connectors 72, can be used with additional distribution blocks 10, to configure electrical system 16 as desired, with receptacles provided in sufficient number and at convenient locations in modular wall panel 18. By adjusting the telescopic overlap of first and second bridge connectors 34 and 54 and the telescopic overlap of first and second bridge connector housings 44 and 64, first and second branch connectors 30 and 32 can be spaced a selected distance from third and fourth branch connectors 50 and 52 so that receptacles 74 connected on opposite sides of distribution block 10 are properly aligned with opposite faces of modular wall 18.

Those skilled in the art will recognize the manner in which receptacles 74 and jumper cables 76 can be connected to each other and/or to one or more terminal blocks 10 to provide a series of receptacles exposed on the opposite faces of modular wall panel 18.

The present invention provides a distribution block that is adjustable to fit within walls of different thickness. The number of different parts required for modular electrical systems in modular walls is reduced.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical distribution block comprising:

a first connector assembly having a first plurality of electrical branch connectors and a first bridge portion including first bridge connectors electrically connected to said first plurality of electrical branch connectors, each said first bridge connector being a male terminal;

a second connector assembly having a second plurality of branch connectors and a second bridge portion including second bridge connectors electrically connected to said second plurality of electrical branch connectors, each said second bridge connector being a female terminal, each said male terminal being received within a corresponding said female terminal;

said bridge connectors of said first bridge portion and said bridge connectors of said second bridge portion adapted for direct electrical connection to each other along a variable length establishing a variable spacing between said first connector assembly branch connectors and said second connector assembly branch connectors.

2. The electrical distribution block of claim 1, said first bridge portion and said second bridge portion having telescoping housings shielding said first and second bridge connectors.

3. The electrical distribution block of claim 2, said first and second bridge connectors including male bridge connectors and female bridge connectors adapted for telescopic engagement.

4. The electrical distribution block of claim 1, said first plurality of electrical connectors including first and second branch connector groups facing in opposite directions.

5. The electrical distribution block of claim 4, said first bridge connectors of said first bridge portion disposed perpendicular to said first and second branch connector groups of said first connector assembly.

6. The electrical distribution block of claim 4, said second plurality of electrical connectors including third and fourth branch connector groups facing in opposite directions.

7. The electrical distribution block of claim 6, said first and second bridge connectors of said first and second bridge portions disposed perpendicular to said first, second, third and fourth branch connector groups.

8. The electrical distribution block of claim 7, said first bridge portion and said second bridge portion having telescoping housings shielding said first and second bridge connectors.

9. The electrical distribution block of claim 8, said first and second bridge connectors including male bridge connectors and female bridge connectors adapted for telescopic engagement.

10. The electrical distribution block of claim 1, wherein said each male terminal includes an elongated flat blade, each said female terminal has an upper element end and a lower element end, each said upper element end biased towards a corresponding said lower element end.

11. An electrical distribution block comprising:

a first T-shaped connector assembly having first and second branch connectors extending in opposite directions relative to each other, and first bridge connectors extending perpendicular thereto, each said first bridge connector being a male terminal, both said first branch connectors and said second branch connectors electrically connected to a corresponding said first bridge connector; and a second T-shaped connector assembly having third and fourth branch connectors extending in opposite directions relative to each other, and second bridge connectors extending perpendicular thereto, each said second bridge connector being a female terminal, both said third branch connectors and said fourth branch connectors electrically connected to a corresponding said second bridge connector;

said first and second bridge connectors adapted for telescopic engagement with each other by insertion of said male terminal into a corresponding said female terminal.

12. The electrical distribution block of claim 11, said first and second connector assemblies including first and second bridge connector housings surrounding said first and second bridge connectors, respectively, said first and second bridge connector housings adapted for telescopic engagement with each other.

13. The electrical distribution block of claim 12, said first and second bridge connectors including male and female connectors.

14. The electrical distribution block of claim 11, wherein said each male terminal includes an elongated flat blade, each said female terminal has an upper element end and a lower element end, each said upper element end biased towards a corresponding said lower element end.

15. An electrical distribution block comprising:

first and second oppositely directed branch connectors;

third and fourth oppositely directed branch connectors disposed in substantially parallel, spaced relation to said first and second branch connectors; and an electrical bridge disposed between and electrically connecting said first and second branch connectors with said third and fourth branch connectors, said electrical bridge including a plurality of male terminals and a plurality of female terminals, said plurality of male terminals electrically connected to said first and second oppositely directed branch connectors, said plurality of female terminals connected to said third and fourth oppositely directed branch connectors, each said male terminal being received within a corresponding said female terminal wherein said electrical bridge having a variable length for adjusting said spaced relation.

16. The electrical distribution block of claim 15, said electrical bridge having telescopically engaging male and female connectors.

17. The electrical distribution block of claim 16, including a first T-shaped housing surrounding said first and second branch connectors and a first portion of said electrical bridge, and a second T-shaped housing surrounding said third and fourth branch connectors and a second portion of said electrical bridge.

18. The electrical distribution block of claim 17, said first and second T-shaped housings adapted for telescopic engagement with each other along said portions thereof surrounding said electrical bridge.

19. The electrical distribution block of claim 15, including a first T-shaped housing surrounding said first and second branch connectors and a portion of said electrical bridge, and a second T-shaped housing surrounding said third and fourth branch connectors and another portion of said electrical bridge.

20. The electrical distribution connector of claim 18, said first and second T-shaped housings adapted for telescopic engagement with each other along said portions thereof surrounding said electrical bridge.

21. The electrical distribution block of claim 15, wherein said each male terminal includes an elongated flat blade, each said female terminal has an upper element end and a lower element end, each said upper element end biased towards a corresponding said lower element end.

* * * * *

UNITED STATES PATENT AND TRADEMARK OFFICE

CERTIFICATE OF CORRECTION

PATENT NO. : 6,652,288 B2
DATED : November 25, 2003
INVENTOR(S) : Laukhuf et al.

It is certified that error appears in the above-identified patent and that said Letters Patent is hereby corrected as shown below:

Column 6,
Line 58, please delete “claim 18”, and substitue therefore -- claim 19 --.

Signed and Sealed this

Seventeenth Day of August, 2004

JON W. DUDAS
*Acting Director of the United States Patent and Trademark Office*